United States Patent [19]

McCarthy et al.

[11] Patent Number: 4,622,624

[45] Date of Patent: Nov. 11, 1986

[54] UNDER SHELF TASK LIGHTING FIXTURE

[75] Inventors: David G. McCarthy, Huntington; Ronald R. Eichorn, New Haven, both of Conn.

[73] Assignee: Electri-Cable Assemblies, Inc., Shelton, Conn.

[21] Appl. No.: 735,396

[22] Filed: May 17, 1985

Related U.S. Application Data

[63] Continuation of Ser. No. 502,945, Jun. 10, 1983, abandoned.

[51] Int. Cl.[4] ..... F21S 3/00; F21V 11/04

[52] U.S. Cl. ..... 362/217; 362/281; 362/319

[58] Field of Search ..... 362/217–225, 362/260, 280, 277, 290, 321, 319, 279, 281, 332, 258; 350/272, 263, 316

[56] References Cited

U.S. PATENT DOCUMENTS

| | | | |
|---|---|---|---|
| 1,801,010 | 4/1931 | Koenig | 362/321 |
| 2,186,203 | 1/1940 | Centeno | 350/272 |
| 2,337,745 | 12/1943 | Garstang | 362/260 |
| 3,016,454 | 1/1962 | Simms | 362/321 |
| 3,052,172 | 9/1962 | Maurer | 362/354 X |
| 3,052,372 | 9/1962 | Shephard | 362/354 X |
| 3,210,533 | 10/1965 | Mappes | 362/369 |
| 4,070,566 | 1/1978 | Buck et al. | 362/369 |
| 4,074,124 | 2/1978 | Maute et al. | 362/217 |
| 4,222,094 | 9/1980 | Wolar | 362/279 |
| 4,233,651 | 11/1980 | Fabbri | 326/319 X |
| 4,323,955 | 4/1982 | Mark | 362/280 X |
| 4,368,504 | 1/1983 | Sato et al. | 362/290 X |
| 4,384,318 | 5/1983 | Reibling | 362/290 X |
| 4,392,190 | 7/1983 | Upton | 362/354 X |
| 4,393,323 | 7/1983 | Hubner | 362/223 X |
| 4,418,378 | 11/1983 | Johnson | 362/97 |

FOREIGN PATENT DOCUMENTS

| | | | |
|---|---|---|---|
| 127648 | 5/1948 | Australia | 362/217 |
| 981130 | 5/1951 | France | 362/217 |
| 2404165 | 5/1979 | France | 362/260 |
| 2075652 | 11/1981 | United Kingdom | 362/217 |

*Primary Examiner*—Tony M. Argenbright

*Attorney, Agent, or Firm*—F. Eugene Davis, IV; Mark P. Stone

[57] ABSTRACT

A lighting fixture which may be installed under a shelf or cabinet positioned above a working area or positioned above any area in which illumination is sought. The lighting fixture is capable of easily and effectively directing the light to specific locations within the working area. A florescent tube is disposed along the length of the fixture. It has a reflector located above it. Below the florescent tube there is an elongated perforated metal panel covering approximately one-third of the light opening below the tube. The panel may be moved transverse to the length of the tube along the opening to direct the light from the tube. The panel is preferably formed of one fixed and one identical overlapping, movable, perforated metal panel. The movable panel may be moved parallel to the length of the tube to control the amount of light passing through the panels. The fixture is provided with cord storage in the middle of the back of the fixture. The ballast is mounted via a closed cell foam pad. Key slot screw holes are located in the top of the fixture. The narrow portions of the slots are dimpled upwardly to capture mounting screw heads which are held in place by one or more resilient pads on top of the fixture.

8 Claims, 25 Drawing Figures

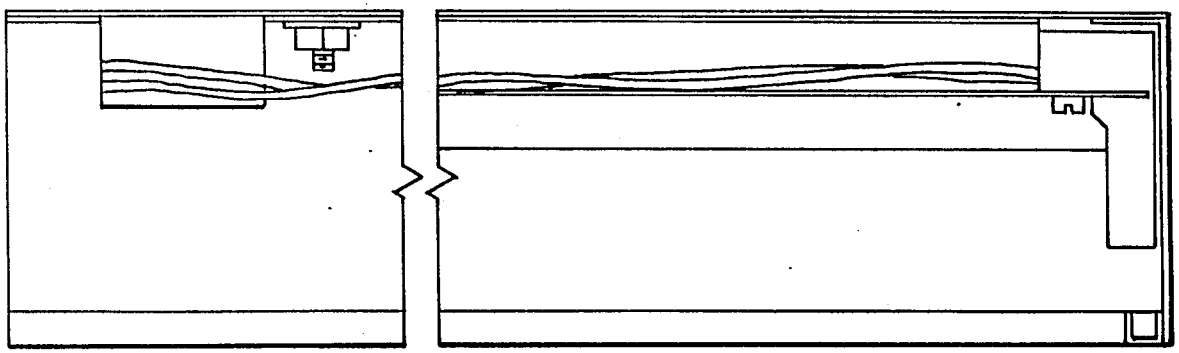
FIG. 13 H
FIG. 13 I
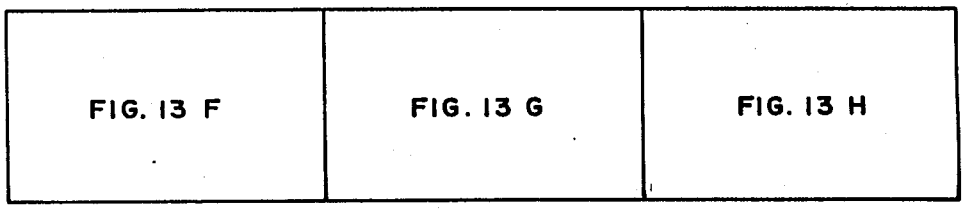

UNDER SHELF TASK LIGHTING FIXTURE

This application is a continuation of U.S. Ser. No. 502,945, filed on June 10, 1983, now abandoned.

TECHNICAL FIELD

This invention relates to an under shelf task lighting fixture. More particularly it relates to a lighting fixture, available in various sizes, which is installed under a shelf or cabinet positioned above a working area. The invention is characterized by a sliding two-piece metal grid formed of perforated metal, which together with the reflector located directly above and about a florescent tube enables the user to perform tasks which require concentrations of light to specific well defined areas and allows for varying the intensity of the light passing through the grid.

BACKGROUND ART

A requirement of anyone working within an office or other work environment is sufficient lighting to perform necessary tasks. As a result of space restrictions and room required for other necessities in the work environment, table lamps or other movable lighting devices are difficult or unacceptable in an office environment. This is because space restrictions limit table-top space for lighting purposes. Permanently installed lighting fixtures positioned directly above the working area are therefore utilized in most business office, or other work environments. They allow individuals to be unencumbered by lamps, and the like, on table tops, desks, etc., which are needed as working spaces, or simply do not provide adequate illumination.

Under the shelf task lighting is well known and preferred in modular offices. However, an inherent deficiency of these lighting fixtures is that that the user has little or no control over the area illuminated, or the intensity of the illumination. Furthermore, glare is a major problem resulting from standard task lighting fixtures.

The use of juxtaposed elements which allow for larger or smaller amounts of light to pass through is known in the art; see U.S. Pat. No. 2,186,203, entitled "Optical Filter", inventor, M. Centeno V. However, neither this patent nor any known to the applicant disclose or suggest that such a filter or screening device be utilized for lighting purposes. Specifically, the prior art does not disclose an adjustable lighting fixture of the type disclosed herein. It has been the object of task lighting to provide inexpensive, efficient and adequate lighting for the user. The prior art simply does not fulfill these requirements. The present invention represents a substantial improvement over the prior art by allowing for the reduction of glare; enabling the user to vary the intensity of the light; and allowing for precision in directing the light emitted.

Other problems of prior art under shelf task lighting fixtures include noise from ballasts, dangling cords, and difficulty in mounting the fixtures.

OBJECTS OF THE INVENTION

It is therefore an object of the present invention to provide a task lighting fixture of simplified construction, and one that is easy to install beneath a shelf or cabinet positioned above a work area.

It is a further object of the present invention to provide a task lighting fixture as described above which will reduce or eliminate the glare caused by conventional task lighting fixtures.

It is another object of the present invention to provide a means by which the amount of illumination may be increased or decreased in accordance with the desires or requirements of its user.

It is still another object of the invention to provide means by which the user may adjust the direction or angle of illumination.

It is still another object of the invention to provide a storage compartment for the cord and plug within the fixture.

It is a further object of the invention to provide a task lighting fixture as described above in various lengths to allow for the installation and use of the invention within areas requiring greater or less illumination.

It is another object of the invention to provide a task lighting fixture as stated above that is available in a variety of lengths between 18" and 60".

Still another object of the invention is to provide reduced ballast noise transmission in an under shelf task lighting fixture of the above character.

Other objects of the invention will in part be obvious and will in part appear hereinafter. The invention accordingly comprises the features of construction and arrangement of parts possessing the features, properties and relationship of elements which will be exemplified in the construction hereinafter set forth. The scope of the invention is indicated in the claims.

BRIEF DESCRIPTION OF THE DRAWINGS

For a fuller understanding of the nature and objects of the invention references should be had to the following detailed description taken in connection with the accompanying drawings in which:

FIGS. 13A–13K comprise several views of the fixture of FIG. 1 with a modified movable panel according to the invention.

Similar reference numbers refer to the same elements throughout the several views of the drawings.

BEST MODE FOR CARRYING OUT THE INVENTION

Figure 1:
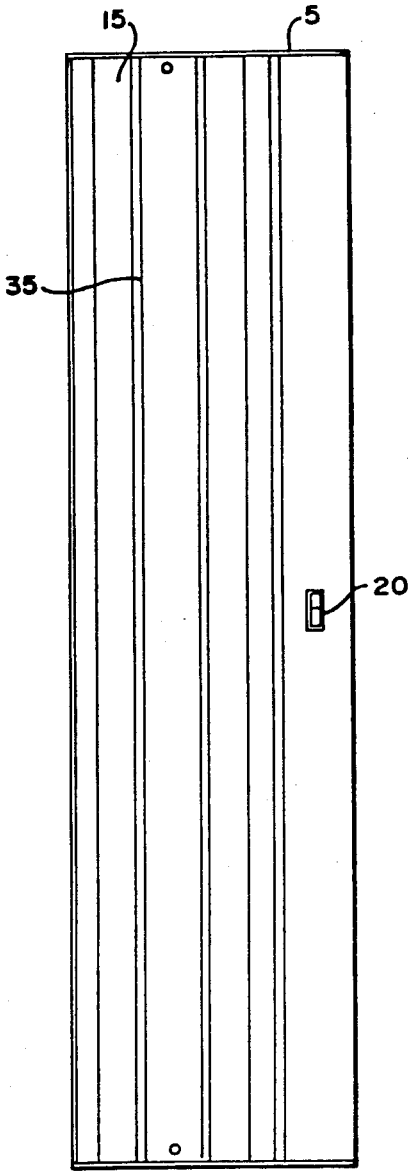
FIG. 1, is a bottom view of an electric task lighting fixture according to the invention which shows the diffuser grid in position directly below the light source.

Referring to FIG. 1, a lighting fixture according to the invention which may be installed under a shelf or cabinet, generally indicated at 5, is shown standing on one side. A florescent tube 25 (FIG. 4) is disposed along the length of the fixture and has a reflector 15 located above and about it. A perforated metal panel 35 may be moved traverse to the length of the tube along the opening, for the purpose of directing light from the tube. The on-off switch is located at 20, positioned on the underside of the light fixture. The fixture is generally rectangular in shape, constructed of fabricated metal and finished with baked enamel. The reflector 15 is a flexible metallic piece which may be inserted in the fixture frame at the end of assembly. As shown in FIG. 13, "Transverse Section" reflector 15 comprises three sections, 14, 16, and 18. The three sections are welded at 13 and 17. The resilient reflector 15 allows for thermal expansion which may result during operation of the fixture and provides easy assembly.

Figure 2:
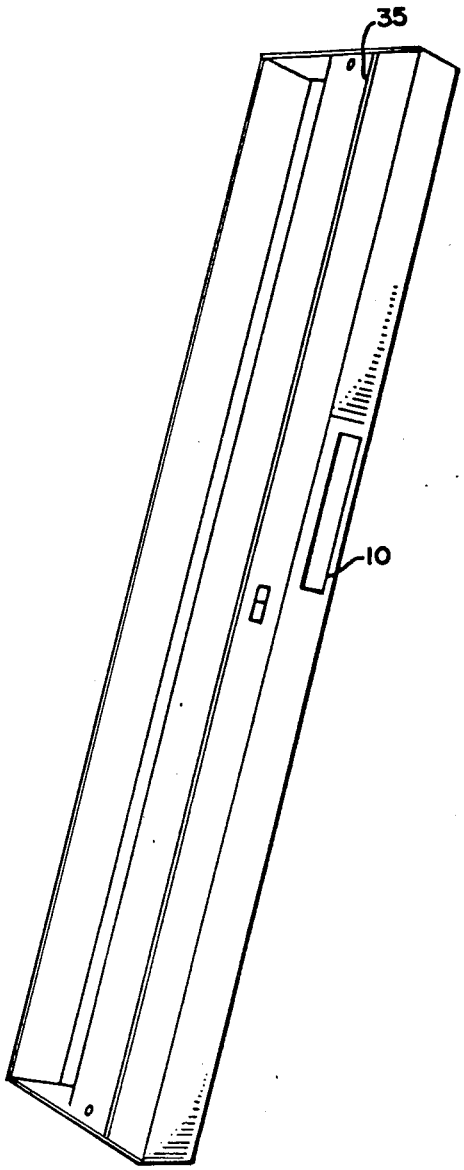
FIG. 2 is a bottom and back view of the fixture of FIG. 1 with the diffuser grid positioned to the rear.

Now referring to FIG. 2, the perforated metal panel 35 is positioned to the rear of the fixture. This leaves florescent tube 25 exposed on the under and forward portions of the fixture 5. With panel 35 in this position, most of the light is directed in a generally forward direction.

The compartment 10 where the cord 11 and plug 12 may be stored also may be seen in FIG. 2. Located in the rear of fixture 5, the storage compartment 10 may contain unused portions of the electrical cord 11. FIG. 13 shows the electrical cord 11 in position relative to ballast 75. The relative position of cord 11 to ballast 75 is the same on fixture 5 regardless of the length of fixture 5 so that the compartment is generally located in the middle of the fixture 5.

Figure 3:
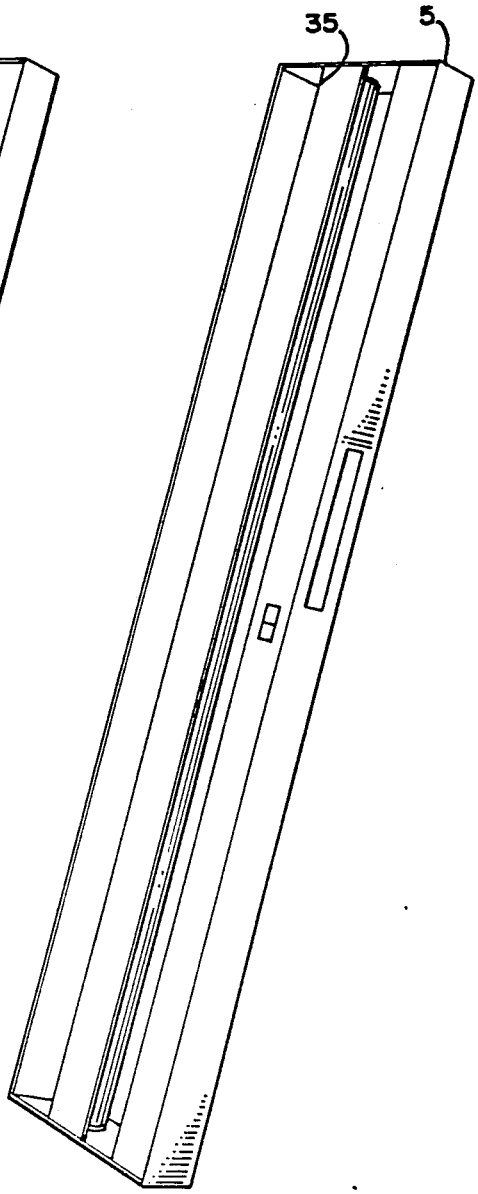
FIG. 3 is a bottom and back view of the fixture of FIG. 1 with the diffuser grid in position directly below the light source.

Referring now to FIG. 3 in lighting fixture 5, the perforated metal panel 35 is directly below the florescent tube 25 and the majority of the light is directed forwardly and rearwardly but not directly below the fixture 5.

Figure 4:
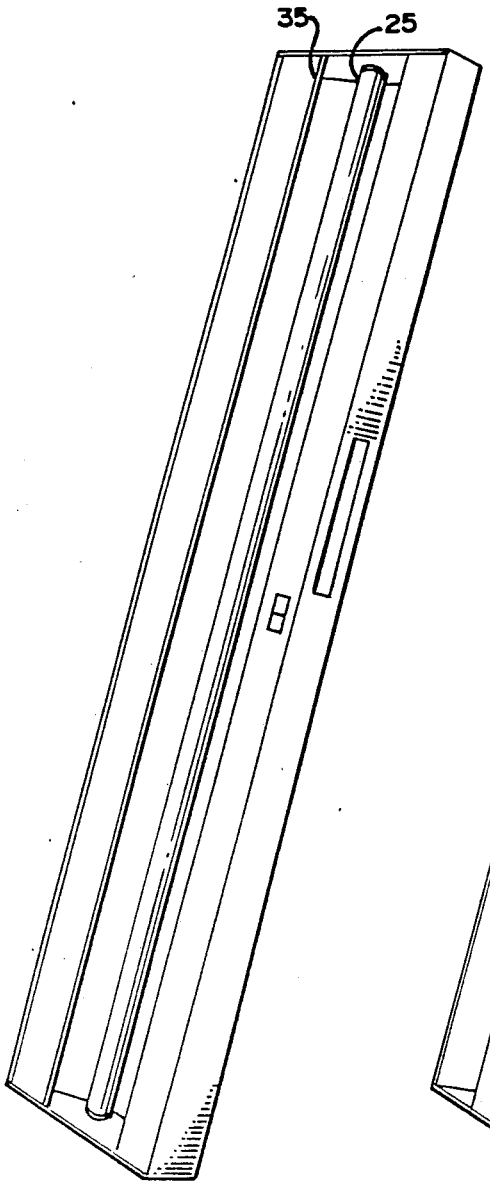
FIG. 4 is a bottom and rear view of the fixture of FIG. 1 with the diffuser grid positioned flush with the front of the invention.

FIG. 4 shows perforated metal panel 35 in a forward position thereby exposing the florescent tube 25. This position will result in light being cast generally rearwardly.

Figure 5:
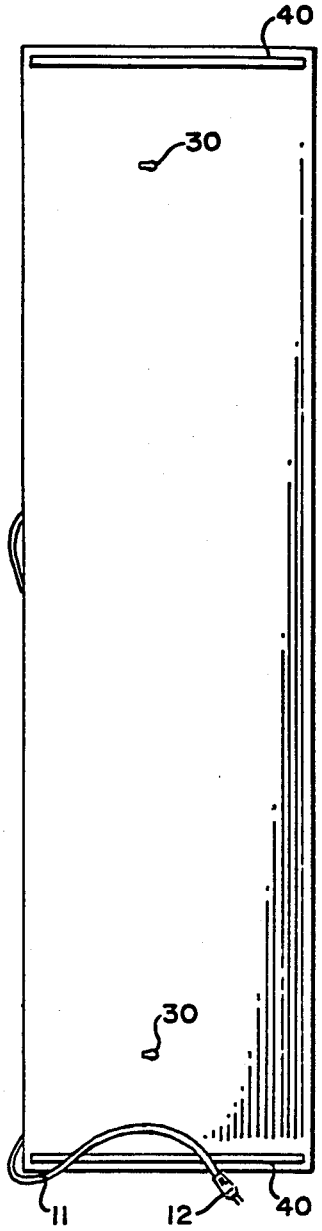
FIG. 5 is a top view of the fixture of FIG. 1 showing the electric cord and plug, the keyhole slots, and foam rubber strips on the side.
Figure 6:
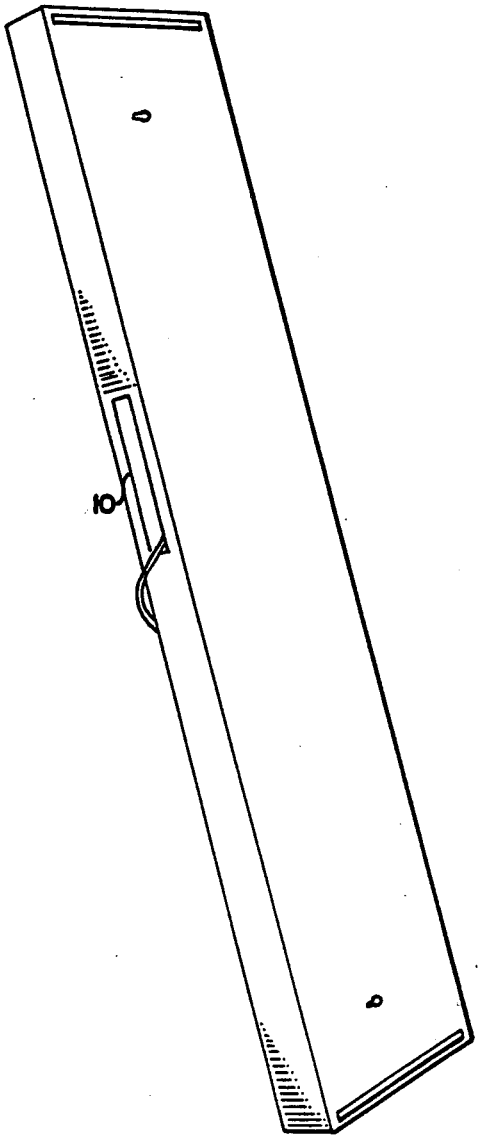
FIG. 6 is a top and back view of the fixture of FIG. 1.
Figure 7:
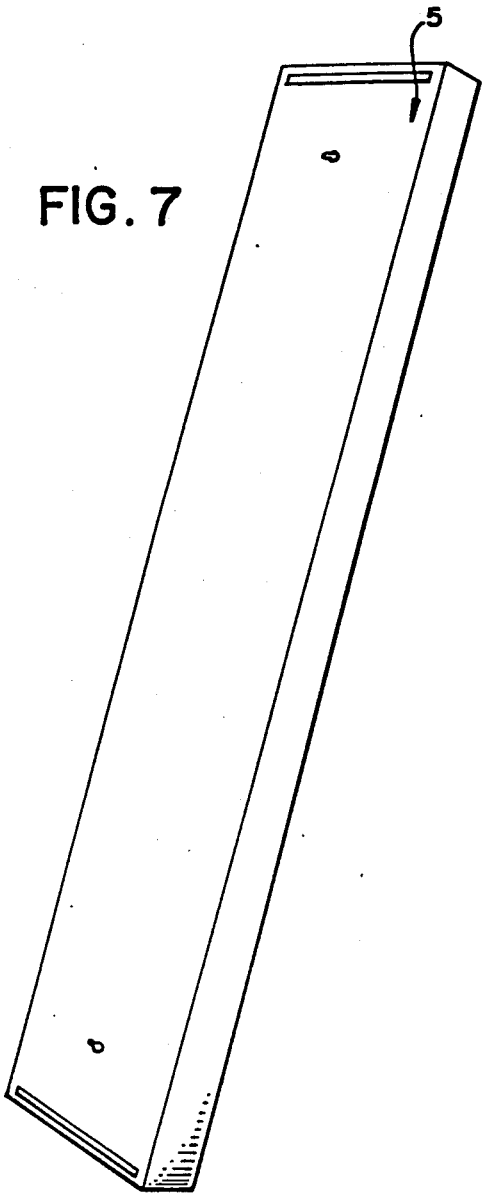
FIG. 7 is a top and front view of the fixture of FIG. 1.

The electric cord 11 and plug 12 of the invention, which are stored in storage compartment 10, can be seen fully extended in FIG. 5. Keyhole slots 30 for mounting the fixture to the underside of a cabinet or the like are positioned on the top of the fixture 5. These keyhole slots are dimpled (see FIG. 13 "Transverse Section") or raised at their narrowest point to allow for effective and safe mounting of the invention. Alternatively, the wide portions of the slots are dimpled down. Cooperating with keyhole slots 30 are closed cell elastomeric strips 40 which meet the cabinet to which fixture 5 is attached. Using two screws (not shown), the fixture 5 may be supported under a cabinet or work shelf. Removal simply requires pushing upward and sliding the fixture 5 backward off the two mounting screws. Strips 40 act to cushion the fixture to the under side of the shelf, reducing ballast 75 vibration, noises and providing desirable ventilation for maximum heat dissipation and longer operational efficiency. They also prevent the fixture from sliding off the screw heads. Installation or removal of the lighting fixture for maintenance, cleaning, or any reason, may be accomplished without the use of any tools. Following installation of two screws to the cabinet or any installation location desired, the fixture 5 may be slid on and off at 30 easily.

Figure 8:
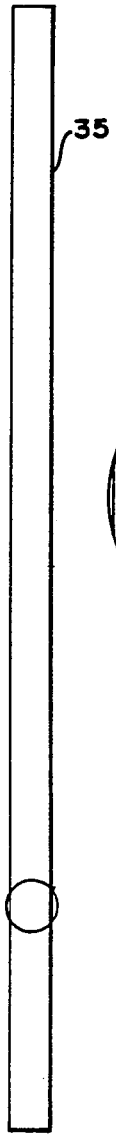
FIG. 8 is a partial top view of the two-part metal diffuser grid of the fixture of FIG. 1 adjusted so that maximum light may pass therethrough.
Figure 8A:
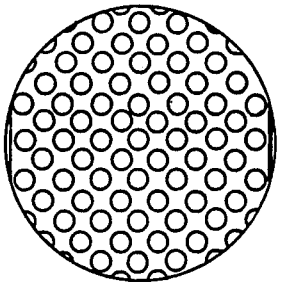
FIG. 8A illustrates an enlargement of the encircled area of FIG. 8.
Figure 10:
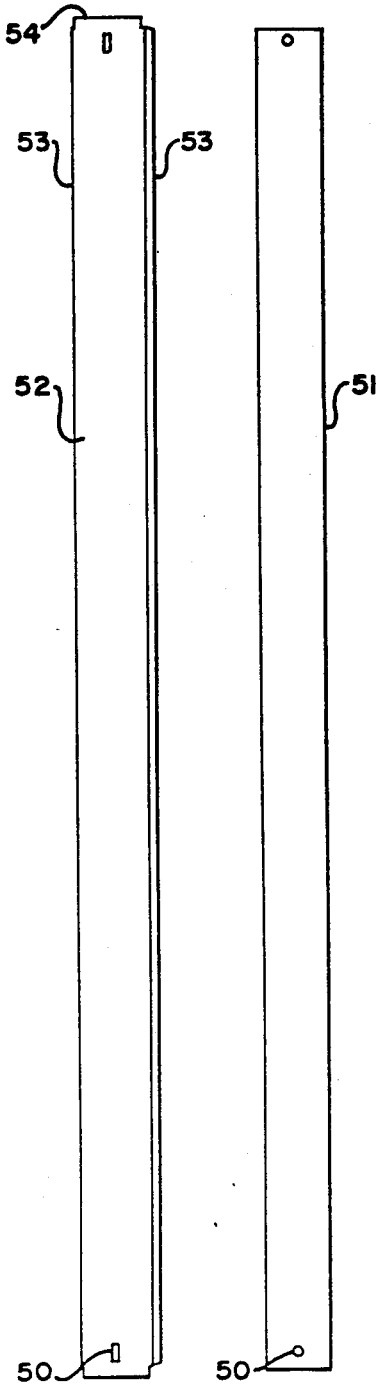
FIG. 10 is a partial perspective view of the two parts of the metal diffuser grid.

Now referring to FIGS. 8 and 8A, a portion of the performated metal panel 35 is shown. It shows the two perforated metal parts of the panel 35 cooperating in a manner which allows for the maximum amount of light to pass through the panels. The panels are of a thin metal construction, the bottom fixed panel 52 overlapping the movable metal panel 51 (FIG. 10). The holes in the panels allow for 41% of the light to pass through when they are aligned as shown in FIGS. 8 and 8A.

Figure 11:
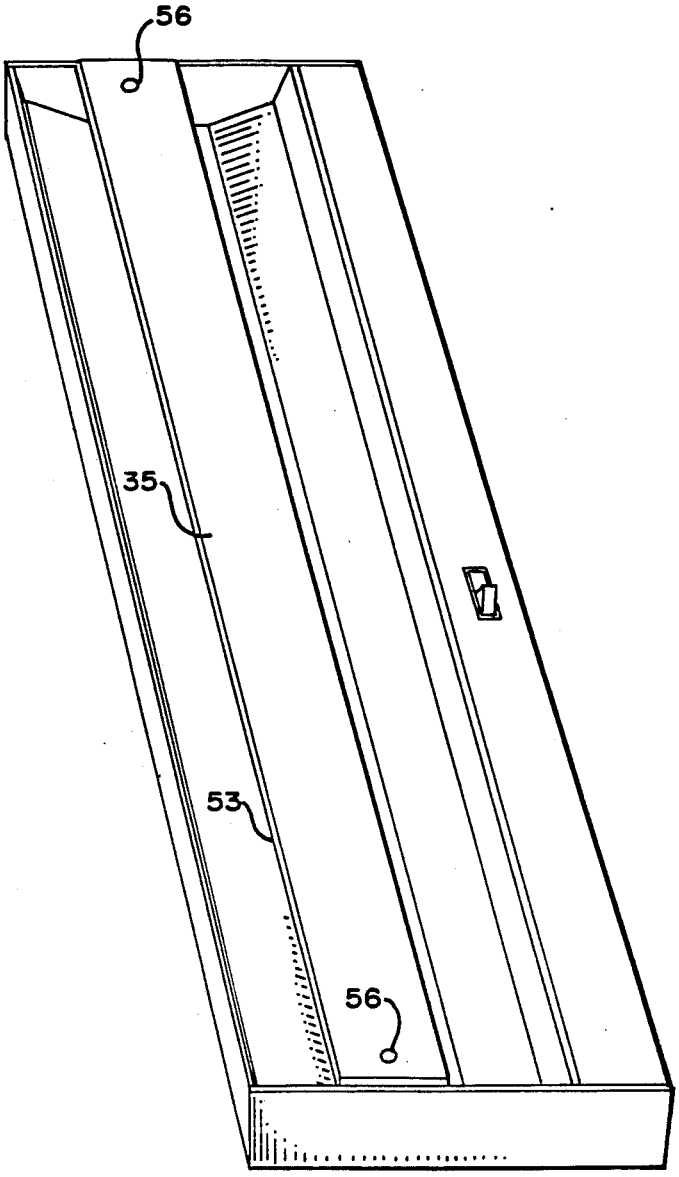
FIG. 11 is a perspective view of the fixture of FIG. 1.

As shown in FIGS. 10 and 11, the panels are affixed to each other at 50 by means of screws and nuts 56 or the like; the fixed portion 52 of the metal panel 35 has side flanges 53 in which the movable grid 51 is trapped. Border flange 53 also strengthenes the panel 52.

The ends of panel 52 are provided with a lip flange 54 (FIG. 10). As shown in FIG. 13 "Longitudinal Section" the lip flange 54 rides on a flange 59 in the fixture 5.

Figure 9:
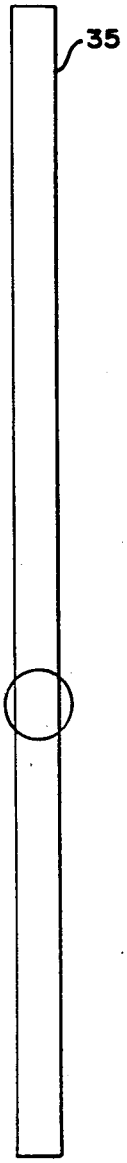
FIG. 9 is a partial top view similar to FIG. 8 of the two-part metal diffuser grid adjusted so that no light may pass therethrough.
Figure 9A:
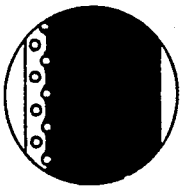
FIG. 9A illustrates an enlargement of the encircled area of FIG. 9.

FIGS. 9 and 9A show the metal panels 51 and 52 aligned so that no light may pass through. In this position metal panels 51 and 52 are aligned so that the openings in movable panel 51 overlap the interstices between openings in the fixed panel 52.

Figure 12:
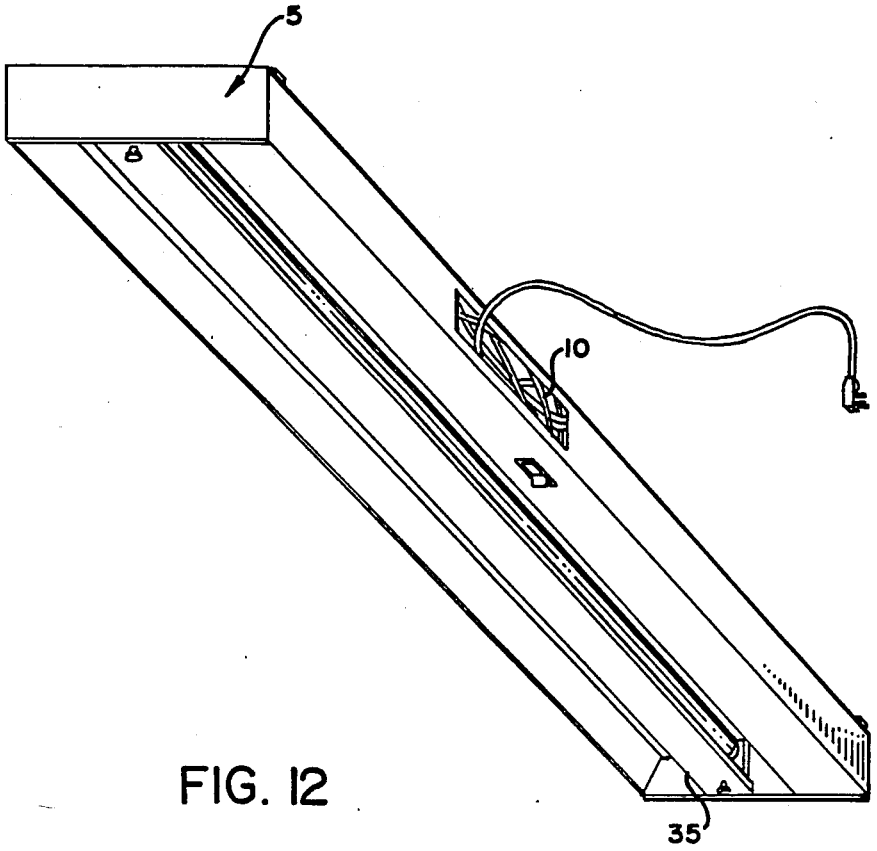
FIG. 12 is another perspective view of the fixture of FIG. 1.
Figure 13A:
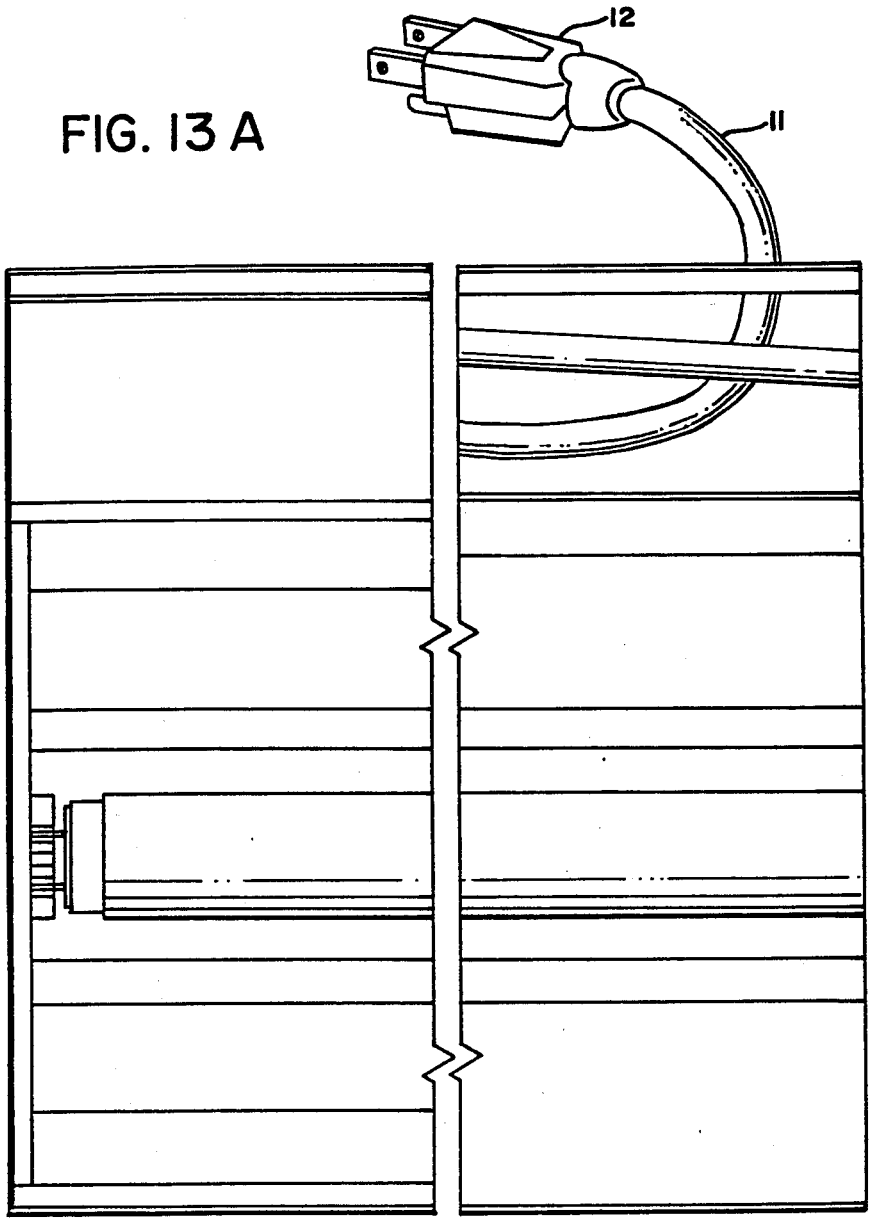
Figure 13B:
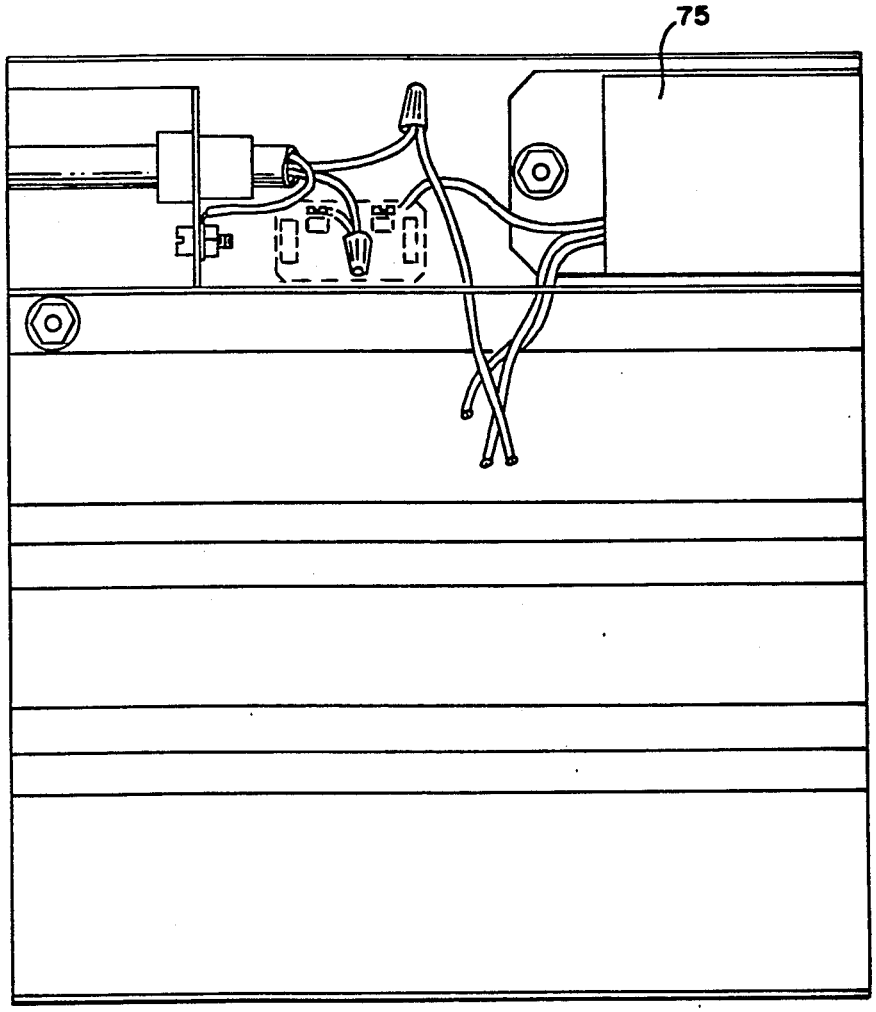
Figure 13C:
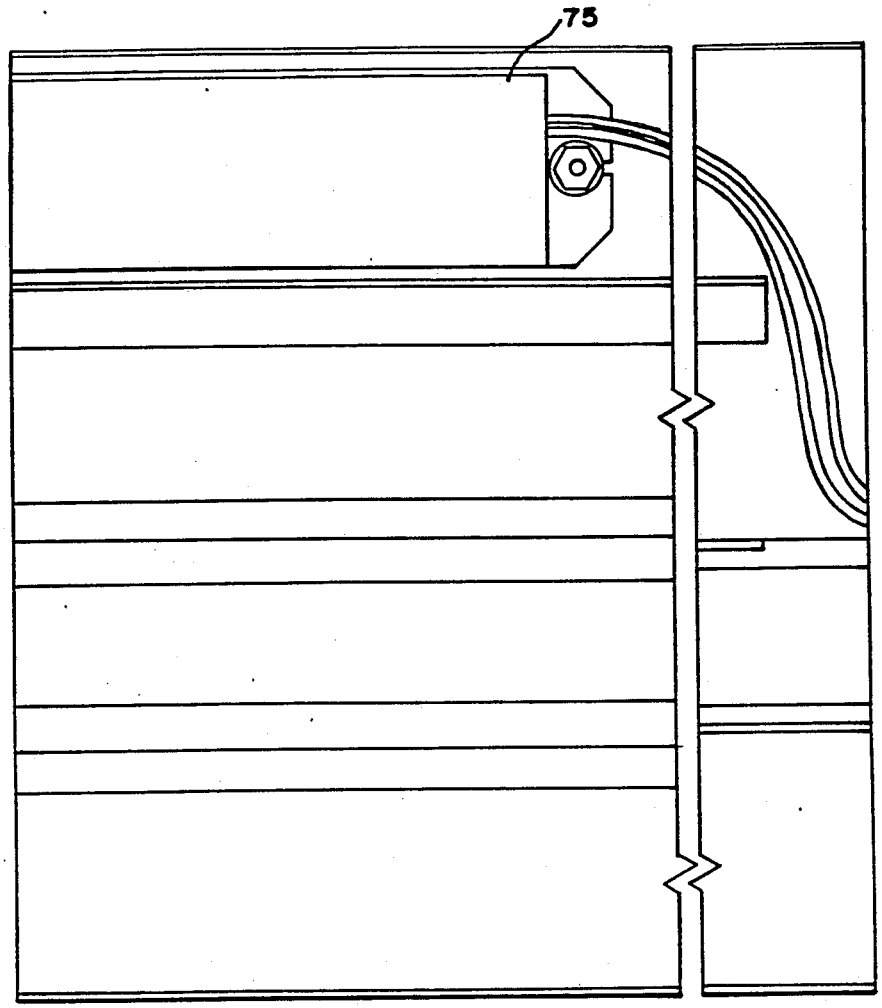
Figure 13D:
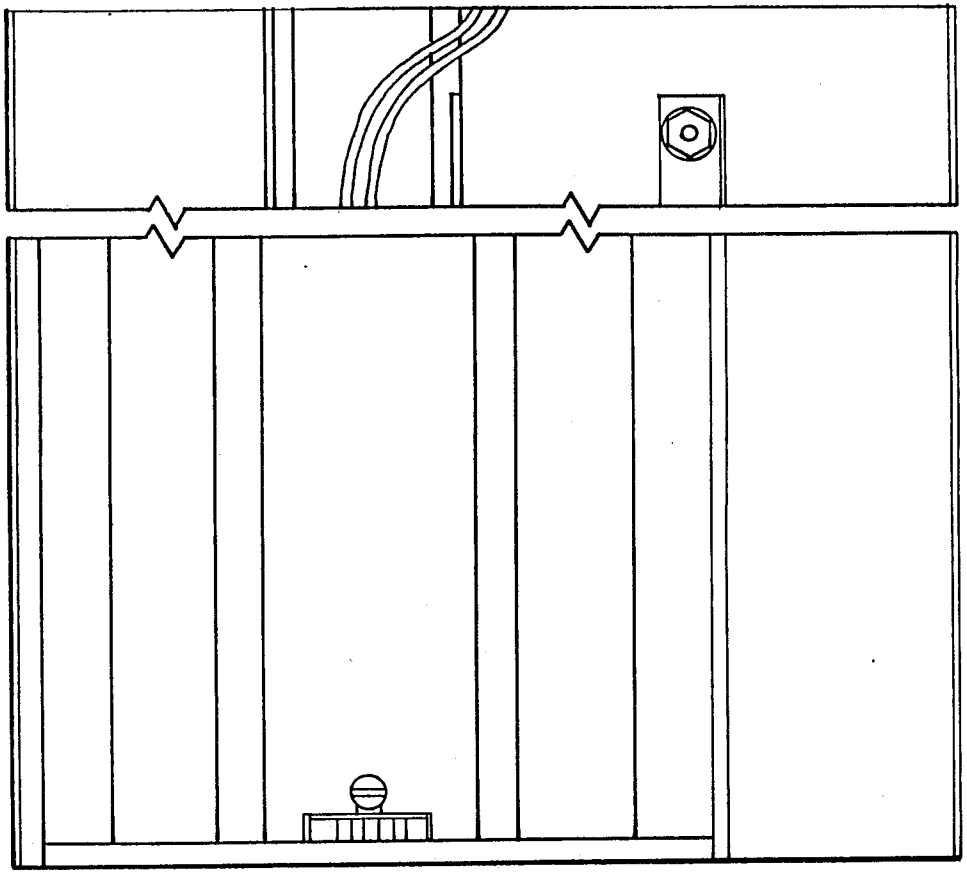
Figure 13E:
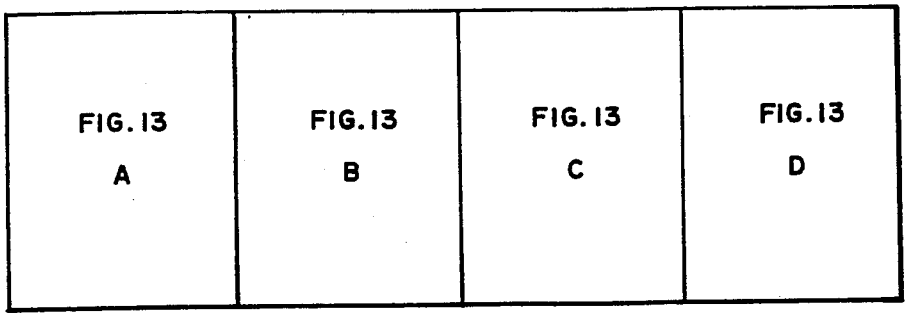
Figure 13F:
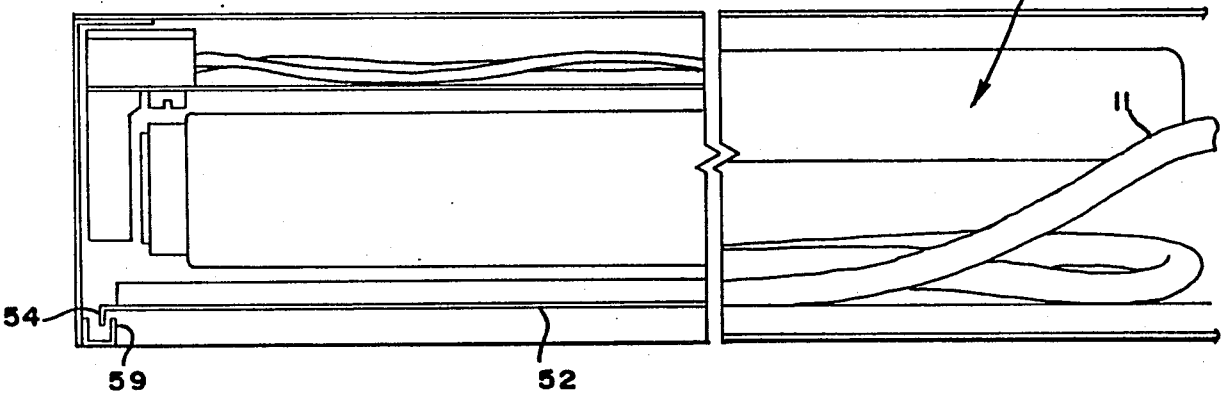
Figure 13G:
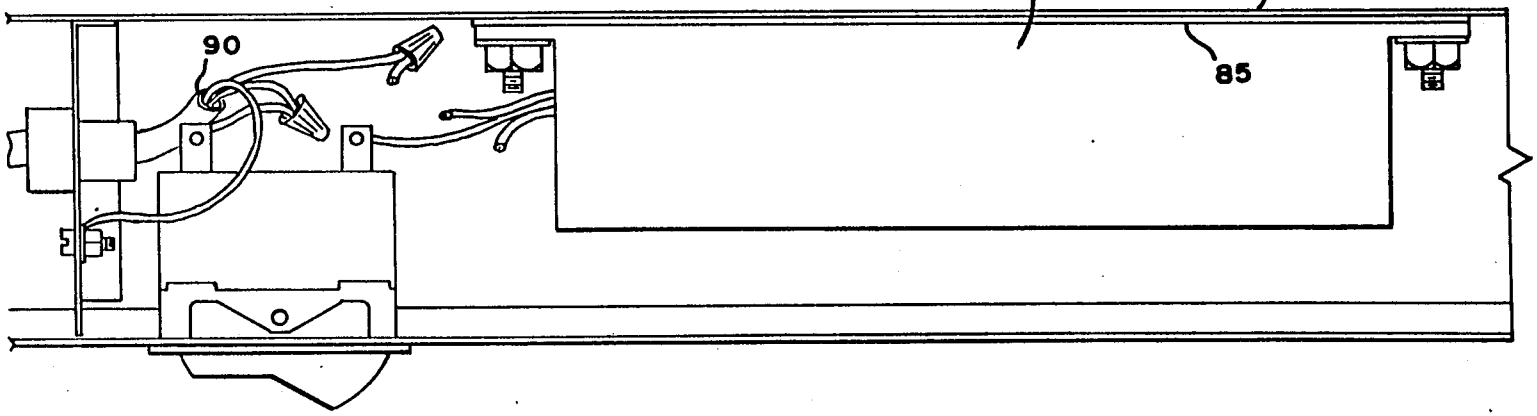
Figure 13J:
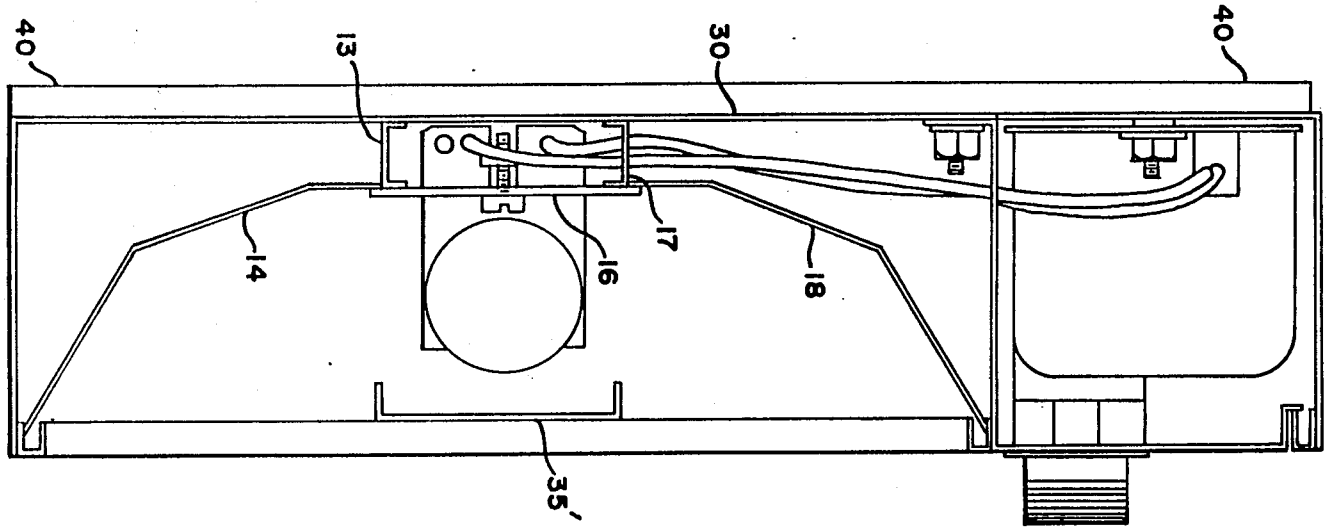
Figure 13K:
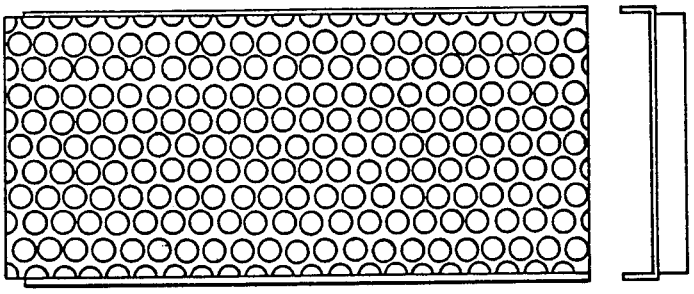

The entire fixture may be seen, with the bottom portion facing up in FIG. 11, and with the bottom portion facing down in FIG. 12.

Now referring to FIG. 13, "Longitudinal Section", a closed cell foam elastomer pad 85 is placed between the ballast 75 and top panel 76 of fixture 5. This foam elastomer pad 85 cushions ballast 75, thus reducing sound transmission from ballast 75. Wiring, indicated generally at 90 between ballast 75 and electrical cord 11, is positioned in a manner relative to the ballast and the electrical cord, that remains unchanged regardless of the length of the fixture 5 so that cord storage area 77 remains substantially in the middle of the fixture.

The panel 35′ is somewhat narrower than the panel 35 of FIGS. 1 through 12 and is formed of a single perforated metal part. Therefore, in this embodiment, there is no control of light transmission through the panel.

The panels 35, 35′, 51, and 52 may be white or silvered on their top surface in order to reflect rather than absorb light.

It will thus be seen that the objects set forth above among those made apparent from the preceding description, are efficiently attained and, since certain changes may be made in the above disclosed system without departing from the scope of the invention it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. An electrical lighting fixture comprising:

A. a light source and a longitudinally oriented housing for receiving said light source;

B. a reflector within said housing and having a light emitting opening therein;

C. a perforated panel part movably mounted to said longitudinally oriented housing and extending over substantially less than 100% of said opening; and D. means for selectively moving said perforated panel part in a direction which is transverse to said longitudinally oriented housing for selectively modifying the direction in which light is emitted from said fixture such that the majority of said emitted light may be directed forwardly of said fixture, rearwardly of said fixture, or both forwardly and rearwardly of said fixture, depending upon the transverse position of said panel part relative to said housing.

2. An electrical lighting fixture as defined in claim 1 wherein said light source is a florescent tube and said panel part is an elongated strip parallel to said longitudinally oriented housing.

3. An electrical lighting fixture as defined in claim 1 wherein said panel part extends over substantially $\frac{1}{3}$ of said opening.

4. An electrical lighting fixture as defined in claim 2 wherein said panel part extends over substantially $\frac{1}{3}$ of said opening.

5. An electrical lighting fixture as claimed in claim 1 wherein said housing is rectangular shaped.

6. An electrical lighting fixture as defined in claim 1 wherein said light source is linearly extended in a direction parallel to the longitudinal orientation of said housing.

7. An electrical lighting fixture comprising:

a light source and a longitudinally oriented housing for receiving said light source;

a reflector within said housing and having a light emitting opening therein;

a perforated panel part movably mounted on said housing and comprising two cooperating perforated panels extending over substantially less than 100% of said opening in a direction parallel to said housing;

means for selectively moving said perforated panel part in a direction which is transverse to said longitudinally oriented housing for selectively modifying the direction in which light is emitted from said fixture such that the direction of said emitted light is determined by the transverse position of said panel part relative to said housing; and means for selectively moving said cooperating perforated panels relative to each other in a direction parallel to said longitudinally oriented housing to control the amount of light emitted from said fixture through said panel part;

whereby the relative position of said perforated panel part may be adjusted to control both the direction and amount of light emitted from said fixture.

8. An electrical lighting fixture as claimed in claim 7 wherein said housing is rectangular shaped.

* * * * *